US010709226B2

(12) United States Patent
Tarling

(10) Patent No.: US 10,709,226 B2
(45) Date of Patent: Jul. 14, 2020

(54) ADJUSTABLE COSMETIC APPLICATOR

(71) Applicant: L'Oreal, Paris (FR)

(72) Inventor: Christopher Tarling, Clark, NJ (US)

(73) Assignee: L'Oreal, Paris (FR)

( * ) Notice: Subject to any disclaimer, the term of this patent is extended or adjusted under 35 U.S.C. 154(b) by 601 days.

(21) Appl. No.: 15/384,053

(22) Filed: Dec. 19, 2016

(65) Prior Publication Data

US 2018/0168317 A1 Jun. 21, 2018

(51) Int. Cl.

| | |
|---|---|
| ***A45D 40/26*** | (2006.01) |
| ***A45D 34/04*** | (2006.01) |
| ***A46B 5/00*** | (2006.01) |
| ***A46B 9/02*** | (2006.01) |

(52) U.S. Cl.

CPC ..... *A45D 40/26* (2013.01); *A45D 34/04* (2013.01); *A46B 5/0054* (2013.01); *A46B 9/021* (2013.01)

(58) Field of Classification Search

CPC ..... A45D 40/26; A45D 40/262; A45D 34/04; A45D 34/042

USPC ..... 132/320

See application file for complete search history.

(56) References Cited

U.S. PATENT DOCUMENTS 2,007,245 A * 7/1935 Gimonet ..... A45D 40/02 132/218
2,236,240 A * 3/1941 Lowen ..... A45D 40/18 401/99
2,637,060 A * 5/1953 Cowan ..... A45D 40/28 15/185
2,749,567 A * 6/1956 Krueger ..... A46B 5/0075 15/172
4,396,028 A * 8/1983 Waggoner ..... A45D 34/04 15/144.1
4,991,989 A * 2/1991 Fitjer ..... A45D 33/00 401/155
6,062,757 A * 5/2000 Gueret ..... A45D 40/24 401/122
8,123,712 B2 * 2/2012 Julius ..... A61F 13/38 15/172
8,408,218 B2 * 4/2013 Anderson ..... A45D 40/18 132/218
8,556,528 B2 * 10/2013 Gardner ..... A45D 40/265 401/122
8,783,989 B2 * 7/2014 Weigel ..... A45D 40/24 132/218
9,877,567 B2 * 1/2018 Simard ..... A46B 9/021
D832,521 S * 10/2018 West ..... D28/76
2002/0020425 A1 * 2/2002 Dorsa ..... A45D 34/06 132/218
2005/0129452 A1 * 6/2005 Bosman ..... A45D 40/262 401/122
2006/0169298 A1 * 8/2006 Thiebaut ..... A45D 33/20 132/294

(Continued)

*Primary Examiner* — Nicholas D Lucchesi

(74) *Attorney, Agent, or Firm* — Christensen O'Connor Johnson Kindness PLLC

(57) ABSTRACT

An adjustable cosmetic applicator includes an applicator tip moveable relative to an applicator body between at least a first and a second position and an actuator assembly configured to move the applicator tip between the at least first and second positions. The adjustable cosmetic applicator may include a first integral hinge defined between the applicator tip and the applicator body and a second integral hinge defined between the applicator tip and the actuator assembly.

20 Claims, 11 Drawing Sheets

(56) References Cited

U.S. PATENT DOCUMENTS

| | | | | |
|---|---|---|---|---|
| 2009/0097899 | A1* | 4/2009 | Carroll | A45D 40/02<br>401/109 |
| 2013/0051894 | A1* | 2/2013 | Lim | A45D 40/20<br>401/88 |
| 2014/0109927 | A1* | 4/2014 | Simard | A46B 9/021<br>132/200 |
| 2019/0261764 | A1* | 8/2019 | Burger | A45D 40/262 |

* cited by examiner

ADJUSTABLE COSMETIC APPLICATOR

SUMMARY

In one exemplary embodiment, an adjustable cosmetic applicator includes an applicator tip moveable relative to an applicator body between at least a first and a second position and an actuator assembly configured to move the applicator tip between the at least first and second positions.

In another exemplary embodiment, an adjustable cosmetic applicator includes an applicator tip moveable relative to an applicator body between at least a first and a second position, a first integral hinge defined between the applicator tip and the applicator body, an actuator assembly configured to move the applicator tip between at least the first and second positions, and a second integral hinge defined between the applicator tip and the actuator assembly.

In one aspect, the actuator assembly is configured to move the applicator tip between the at least first and second positions upon movement of a tip-moving device.

In another aspect, the adjustable cosmetic applicator includes a locking assembly for securing the tip-moving device in a first or second position.

In yet another aspect, the tip-moving device is slidable along the applicator body through a tracking assembly.

In yet another aspect, the tracking assembly is defined by a guide rail extending axially along the applicator body and first and second guides extending from the tip-moving device that are slidably receivable on the guide rail.

In yet another aspect, the tracking assembly includes a locking assembly for securing the tip-moving device in a first or second position.

In yet another aspect, the locking assembly includes first and second lateral protrusions extending from the guide rail, wherein the first guide passes over the first lateral protrusion to selectively lock the tip-moving device in the first position, and wherein the second guide passes over the second lateral protrusion to selectively lock the tip-moving device in the second position.

In yet another aspect, the locking assembly includes first and second lateral protrusions extending from the guide rail, wherein the second guide passes over the second lateral protrusion to selectively lock the tip-moving device in the first position, and wherein the first guide passes over the first lateral protrusion to selectively lock the tip-moving device in the second position.

In yet another aspect, the applicator tip is in the first position when the tip-moving device is in the first position, and the applicator tip is in the second position when the tip-moving device is in the second position.

In yet another aspect, the applicator tip is in the first position when the tip-moving device is in the second position, and the applicator tip is in the second position when the tip-moving device is in the first position.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this disclosure will become more readily appreciated by reference to the following detailed description, when taken in conjunction with the accompanying drawings, wherein.

DETAILED DESCRIPTION

Cosmetic formulations are often applied to a person's face, hair, skin, nails, etc., with an applicator. The applicator configuration will depend on the intended end use, but it may include an applicator tip defined by a brush, sponge, bristle, molded portion, etc. The applicator tip must be appropriately positioned relative to the person's body for accurate application of the cosmetic formulation thereto. In some instances, it is awkward or difficult to appropriately position the applicator tip relative to the person's body (such as the eyelashes, hair, nails, etc.) for accurate application. Thus, an improved applicator tip that can be easily positioned relative to a person's body or another surface for accurate application of the cosmetic formulation thereto is desired.

Referring to FIGS. 1-6, a first exemplary embodiment of an adjustable cosmetic applicator 20 (hereinafter mostly referred to as simply an "adjustable applicator") will now be described in detail. The adjustable applicator 20 includes an applicator tip 26 movably and adjustably secured to an applicator body 32. In an embodiment, the applicator tip 26 is movable between multiple positions. For example, in an embodiment, the applicator tip 26 is movable between at least a first position, wherein the applicator tip 26 is in a substantially 0-degree position in substantial axial alignment with the applicator body 32 (as shown in FIGS. 2A and 2B and 3A-3C), and a second position, wherein the applicator tip 26 is in a substantially 90-degree position substantially transverse to a longitudinal axis of the applicator body 32 (as shown in FIGS. 4A and 4B and 5A-5C).

Figure 1:
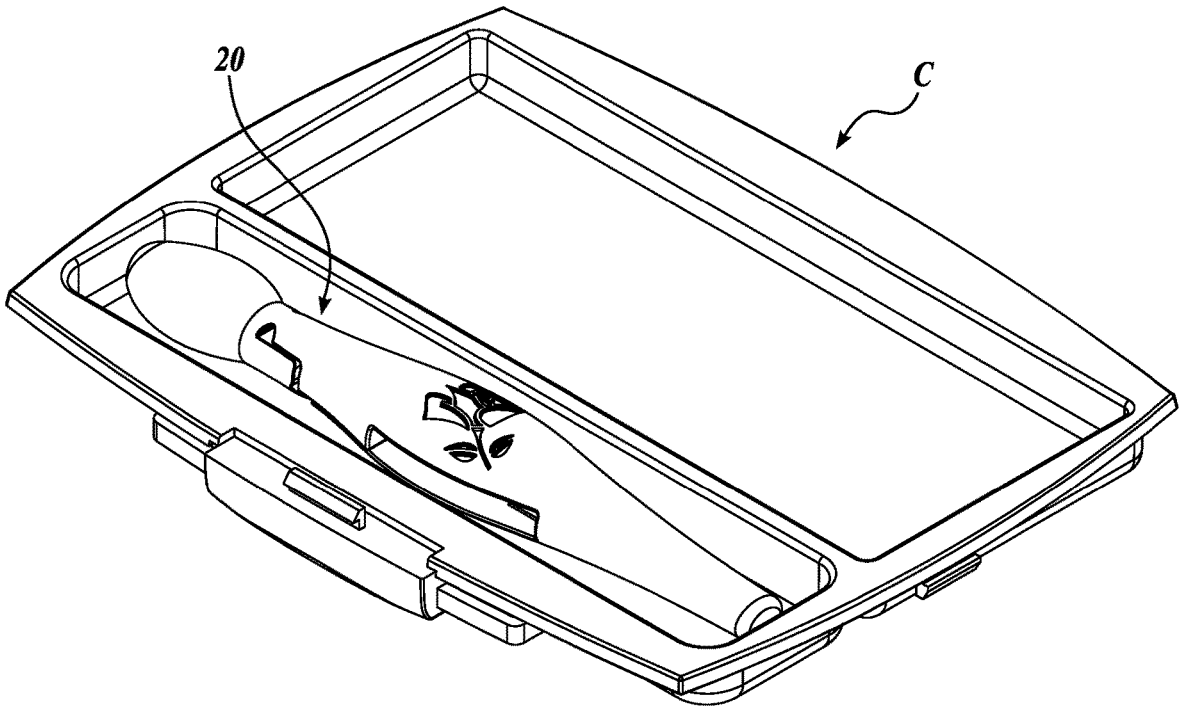
FIG. 1 is an environmental view of an adjustable applicator formed in accordance with a first exemplary embodiment of the present disclosure, shown in use with a cosmetic compact assembly.
Figure 2A:
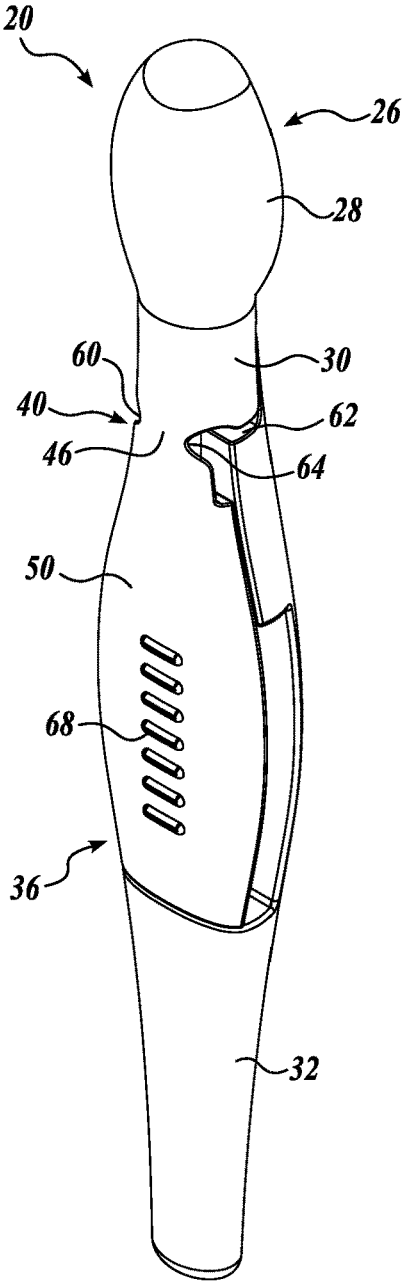
FIG. 2A is a rear isometric view of the adjustable applicator of FIG. 1, wherein the adjustable applicator is shown in a first position.
Figure 2B:
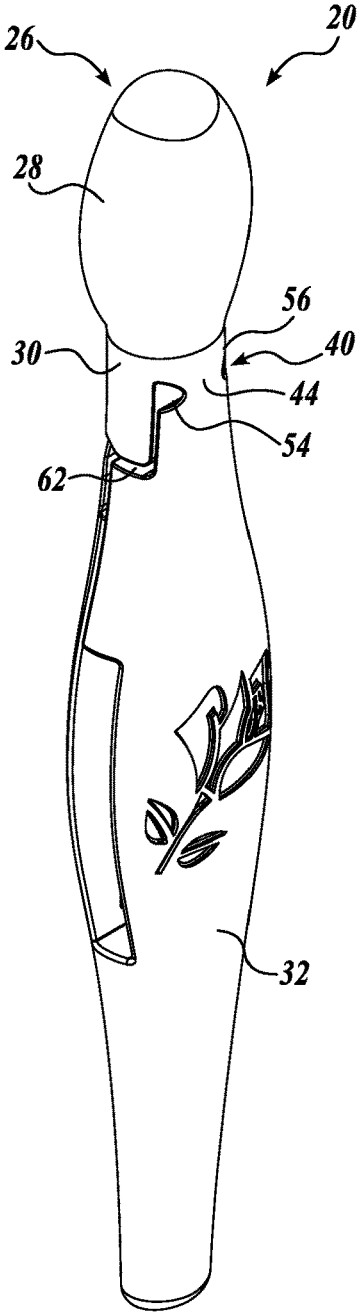
FIG. 2B is a front isometric view of the adjustable applicator of FIG. 2A.
Figure 3D:
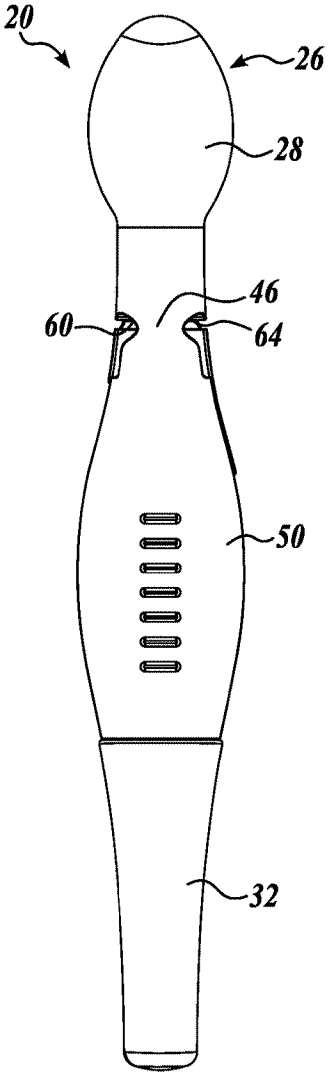
FIG. 3D is a rear elevational view of the adjustable applicator of FIG. 2A.
Figure 3C:
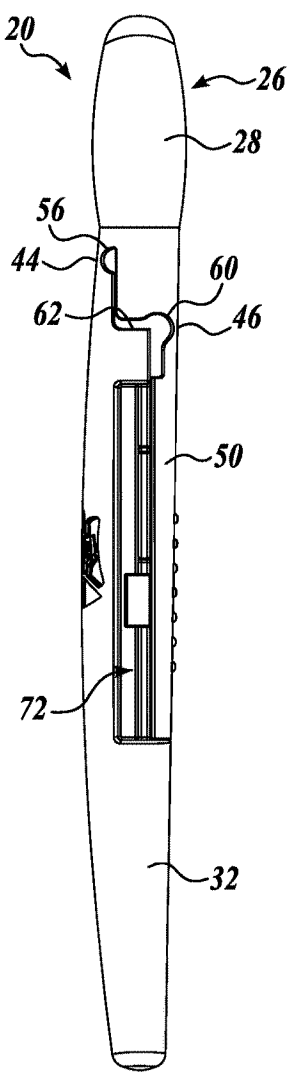
FIG. 3C is a left side perspective view of the adjustable applicator of FIG. 2A.
Figure 3B:
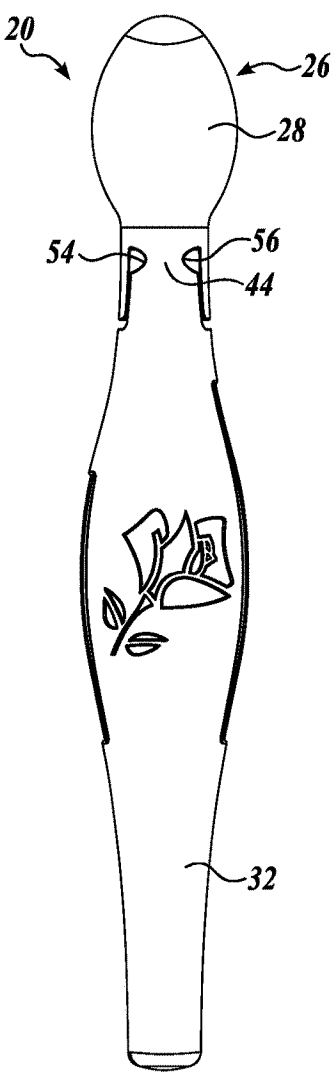
FIG. 3B is a front elevational view of the adjustable applicator of FIG. 2A.
Figure 3A:
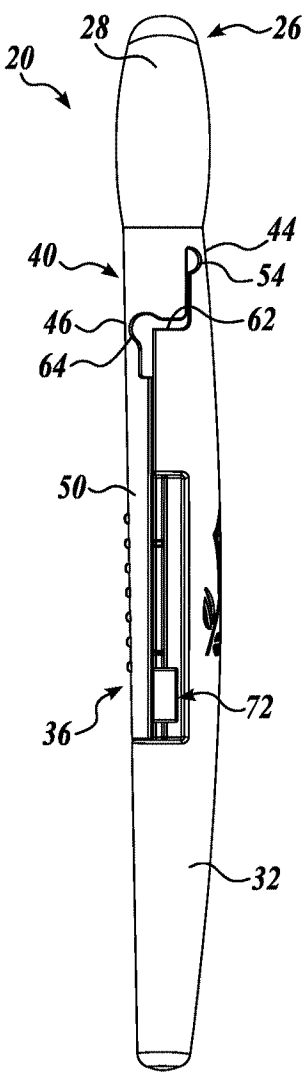
FIG. 3A is a right side perspective view of the adjustable applicator of FIG. 2A.
Figure 4A:
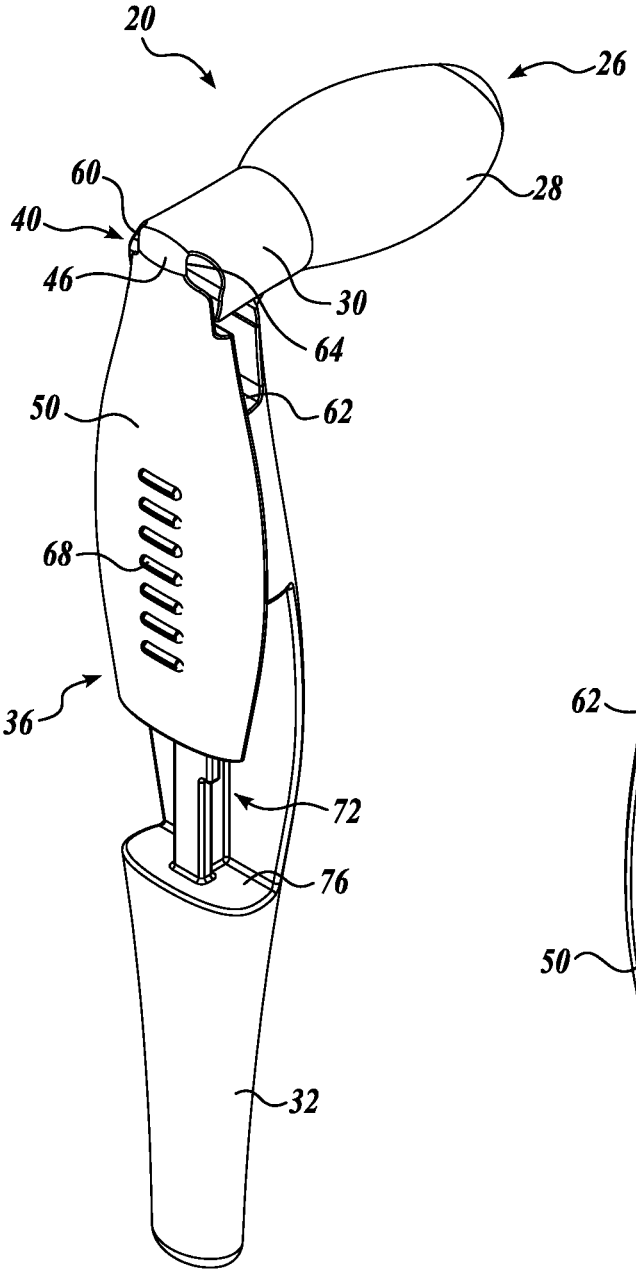
FIG. 4A is a rear isometric view of the adjustable applicator of FIG. 1, wherein the adjustable applicator is shown in a second position.
Figure 4B:
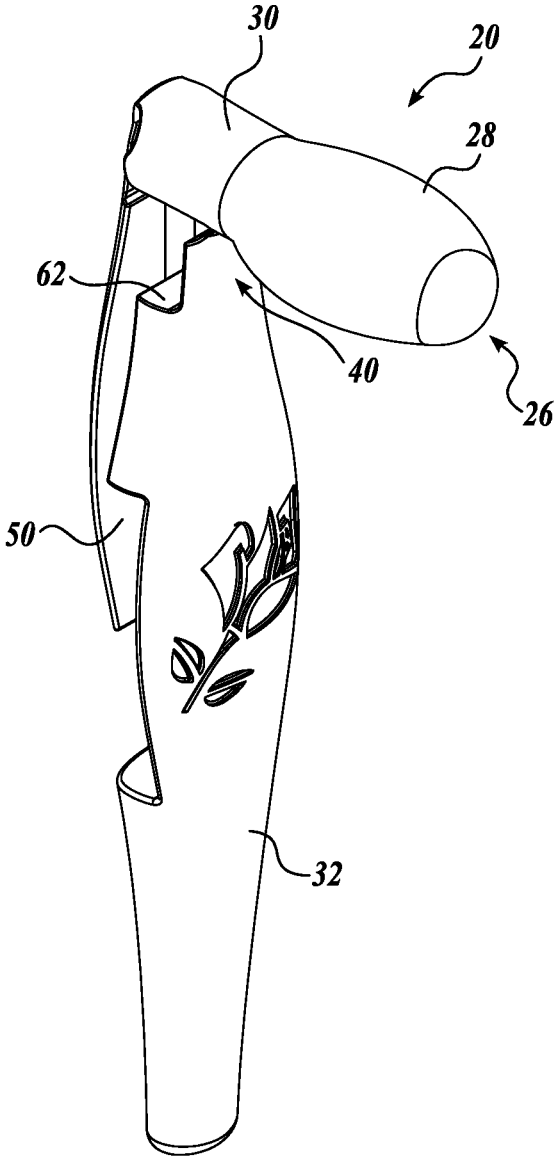
FIG. 4B is a front isometric view of the adjustable applicator of FIG. 4A.
Figure 5A:
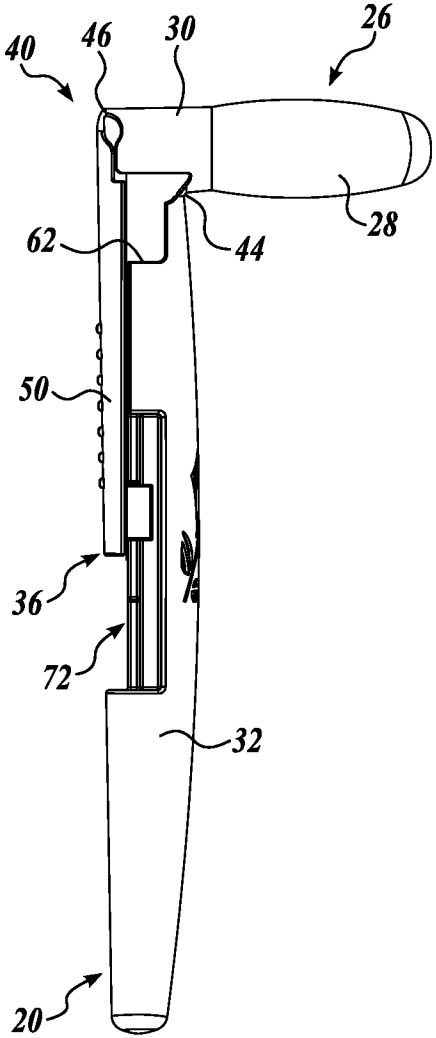
FIG. 5A is a right side perspective view of the adjustable applicator of FIG. 4A.
Figure 5B:
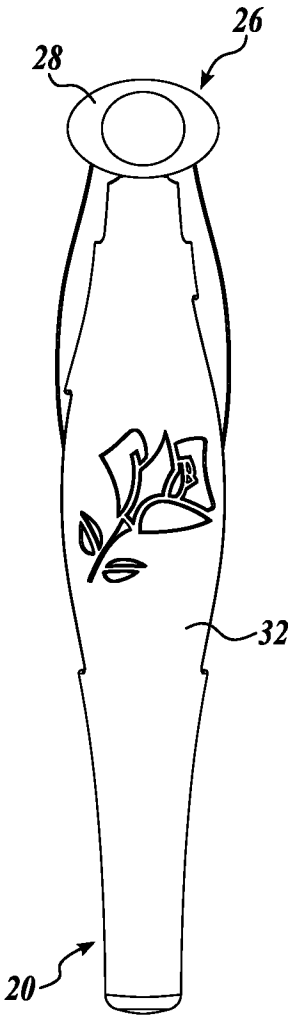
FIG. 5B is a front elevational view of the adjustable applicator of FIG. 4A.
Figure 5C:
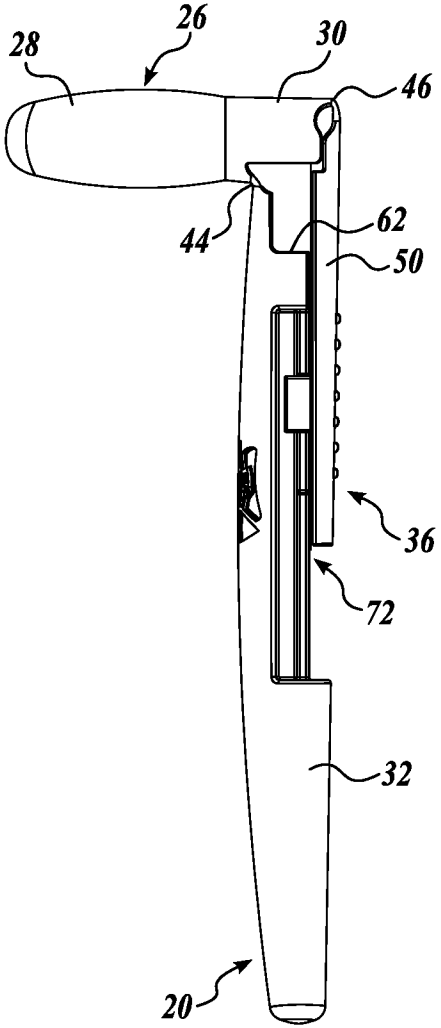
FIG. 5C is a left side perspective view of the adjustable applicator of FIG. 4A.
Figure 5D:
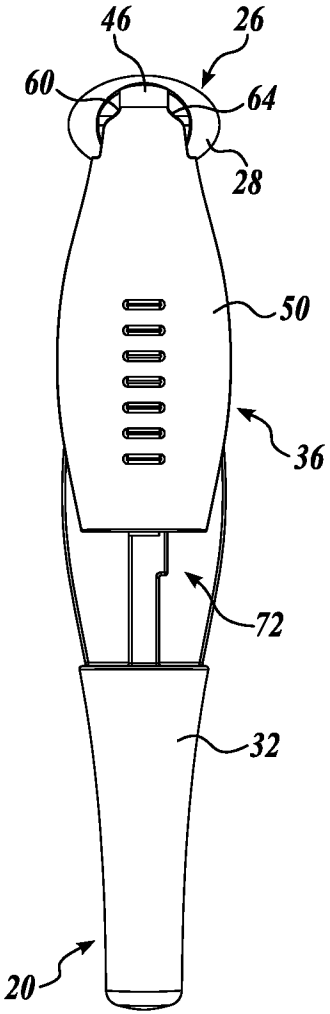
FIG. 5D is a rear elevational view of the adjustable applicator of FIG. 4A.
Figure 6A:
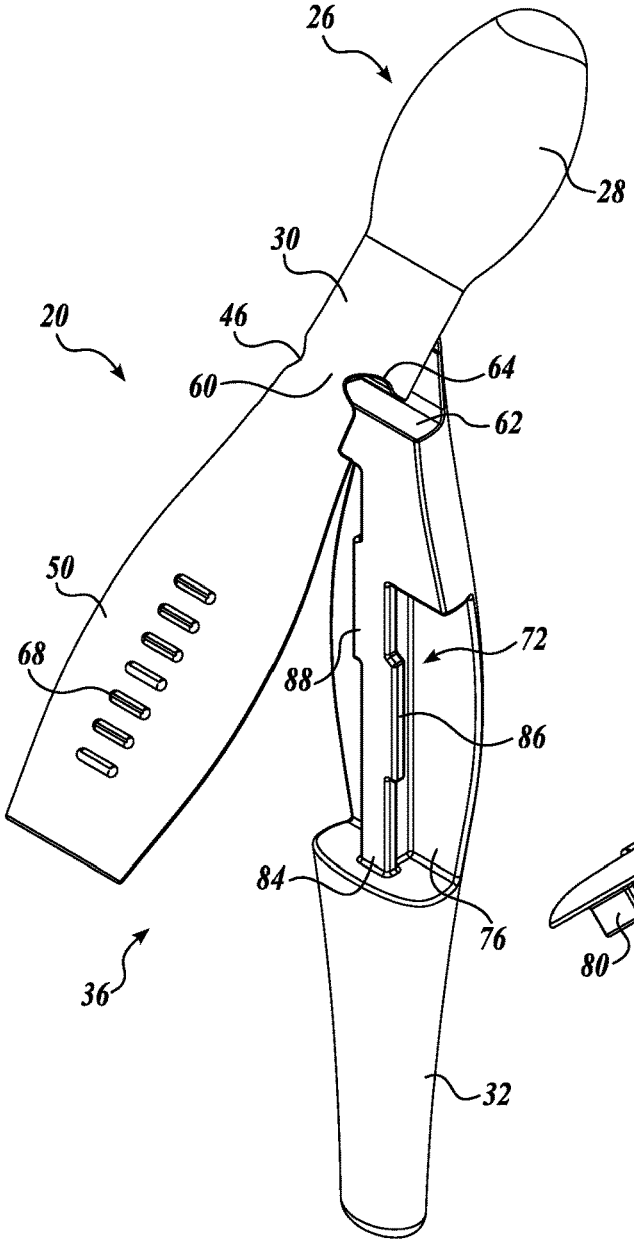
FIG. 6A is a rear isometric partially exploded view of the adjustable applicator of FIG. 1.
Figure 6B:
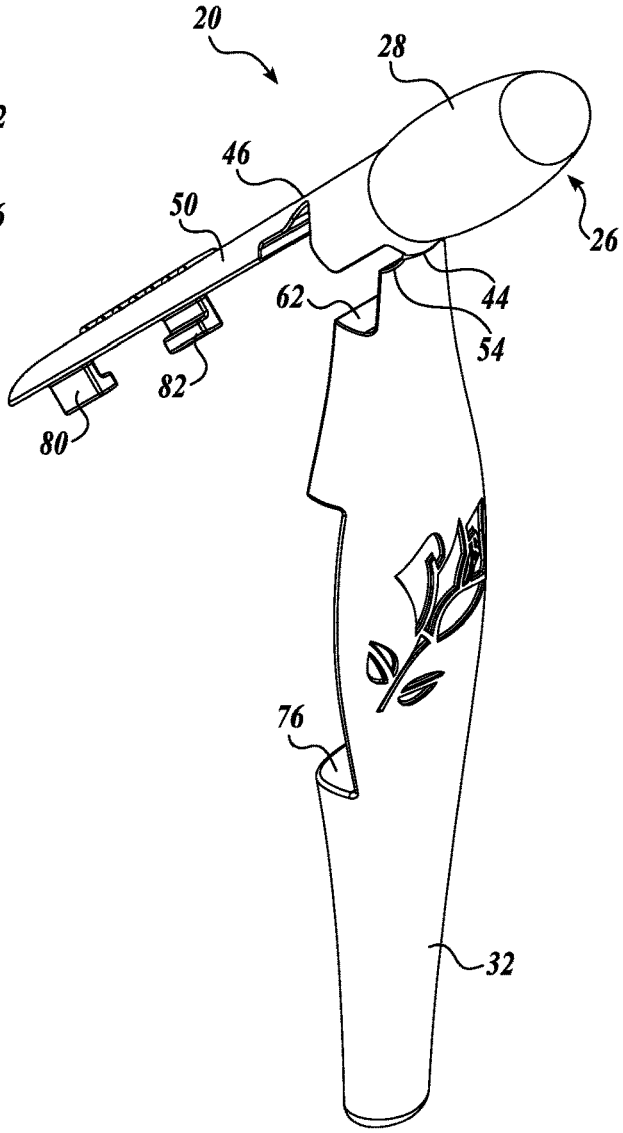
FIG. 6B is a front isometric partially exploded view of the adjustable applicator of FIG. 6A.

The applicator body 32 is a generally contoured elongated body that is easily graspable by a user. In that regard, the applicator body 32 may have a suitable ergonomic shape and contour that conforms to a portion of a user's finger(s) or hand for comfort and ease of use. Moreover, the applicator body 32 may be of a suitable thickness, length, and shape to be stored within a compact makeup assembly C, as shown in FIG. 1, or any other suitable kit or assembly. It should be appreciated that the adjustable applicator 20 may instead include any other suitable applicator body.

The applicator tip 26 includes a tip portion 28 having any suitable configuration for applying a cosmetic product in an intended application. For instance, the tip portion 28 may be a sponge tip applicator for applying foundation, concealer, etc., as shown in the figures. In alternative embodiments, the tip portion 28 may instead be a brush, a bristle assembly, or another suitable configuration for applying various other cosmetic products with the adjustable applicator 20. For instance, the tip portion 26 may be defined as a molded gloss applicator, a mascara applicator, a nail applicator, a fiber brush applicator, or any other suitable applicator.

The applicator tip 26 extends from a base portion 30, wherein the base portion 30 is movably coupled to a first or upper end of the applicator body 32. The base portion 30 is movably secured to the applicator body 32 through a suitable hinge assembly or the like. In the exemplary embodiment, the adjustable applicator 20 includes a hinge assembly 40 having a first integral hinge 44 that moveably couples an upper end of the base portion 30 to the first or upper end of the applicator body 32 on a first side of the adjustable applicator 20. The hinge assembly 40 further includes a second integral hinge 46 disposed on a second opposite side of the adjustable applicator 20 that moveably couples a lower end of the base portion 30 to an upper end of an actuator assembly 36 that is configured to move the applicator tip 26 about the hinge assembly 40. It should be appreciated that any suitable hinge assembly may be used or other suitable assembly may be used for moveably coupling the applicator tip 26 to the applicator body 32.

The base portion 30 is substantially nested or received within a base portion cavity 62 defined near the upper end of the applicator body 32. As briefly described above, the first integral hinge 44 moveably couples an upper end of the base portion 30 to the upper end of the applicator body 32 on a first side of the adjustable applicator 20, and the second integral hinge 46 moveably couples a lower end of the base portion 30 to an upper end of an actuator assembly 36 on a second opposite side of the adjustable applicator 20. With the first and second integral hinges 44 and 46 defined on opposite sides of the applicator 20 at upper and lower ends of the base portion 30, the base portion 30 fits within the base portion cavity 62 when applicator tip 26 is in the first, substantially 0-degree position.

The first and second integral hinges 44 and 46 will now be described in more detail. In the exemplary embodiment, the first integral hinge 44 includes a reduced width portion defined between the first end of the applicator body 32 and an upper end of the base portion 30 to allow flexible bending of the applicator tip 26 between first and second positions. Specifically, the first integral hinge 44 is defined by first and second notches 54 and 56 extending inwardly toward each other to define a first substantially transverse hinge axis (not labeled) between the applicator body 32 and the base portion 30. In that regard, the applicator tip 26 may bend about the first hinge axis extending between the first and second notches 54 and 56 to move between at least the first and second positions.

The applicator tip 26 may bend outwardly about the first hinge axis to move the applicator tip 26 into a second position, wherein the applicator tip 26 is substantially transverse to a longitudinal axis of the applicator body 32 (as shown in FIGS. 4A and 4B and 5A-5C), from a first position, wherein the applicator tip 26 is in substantial axial alignment with the applicator body 32 (as shown in FIGS. 2A and 2B and 3A-3C). Likewise, the applicator tip 26 may bend inwardly about the first hinge axis to move the applicator tip 26 from the second position, wherein the applicator tip 26 is substantially transverse to a longitudinal axis of the applicator body 32 (as shown in FIGS. 4A and 4B and 5A-5C) into the first position, wherein the applicator tip 26 is in substantial axial alignment with the applicator body 32 (as shown in FIGS. 2A and 2B and 3A-3C).

At the same time, the second integral hinge 46 of the hinge assembly 40 allows the applicator tip 26 to be moved by a tip-moving device 50 of the actuator assembly 36. In that regard, the second integral hinge 46 is defined by a reduced width portion defined between a lower end of the base portion 30 and an upper end of the tip-moving device 50. Specifically, the second integral hinge 46 is defined by third and fourth notches 60 and 64 defined on a second side of the adjustable applicator 20 that extend inwardly toward each other. In that regard, the applicator tip 26 bends about a second hinge axis (not labeled) extending between the third and fourth notches 60 and 64 that is substantially transverse to the longitudinal axis of the applicator body 32.

The applicator tip 26 is bendable about the second hinge axis when the tip-moving device 50 is moved upwardly or downwardly along at least a portion of the length of the applicator body 32. More specifically, when the tip-moving device 50 is moved from a first initial position, as shown in FIGS. 2A and 2B and 3A-3D, upwardly into a second actuated position, as shown in FIGS. 4A and 4B and 5A-5D, the applicator tip 26 bends inwardly about the second integral hinge 46 into the second position, as shown in FIGS. 4A and 4B and 5A-5D. Conversely, the tip-moving device 50 is moved from the second actuated position, as shown in FIGS. 4A and 4B and 5A-5D, downwardly into the first initial position, as shown in FIGS. 2A and 2B and 3A-3D to allow the applicator tip 26 to bend outwardly about the second integral hinge 46 and move back into the first position, as shown in FIGS. 2A and 2B and 3A-3D. In other words, the tip-moving device 50 is moved upwardly and downwardly substantially axially along the applicator body 32 to cause flexible bending at the second integral hinge 46 for moving the applicator tip 26 between at least the first and second positions.

The tip-moving device 50 is any suitable shape, size, and configuration that is grippable and movable by a user axially along the applicator body 32. In the exemplary embodiment, the tip-moving device 50 generally has the same size, shape and contour of the applicator body 32 such that when the tip-moving device 50 is in the first or initial position, the tip-moving device 50 substantially conforms to the shape and contour of the applicator body 32. Moreover, the tip-moving device 50 may include a textured or otherwise non-slip exterior surface such that a user may easily grip and slide the tip-moving device 50 axially along the applicator body 32 (such as with a thumb or finger). In the depicted exemplary embodiment, a plurality of bumps or protrusions 68 are defined on the exterior surface of the tip-moving device 50 to provide a non-slip surface for gripping.

The actuator assembly 36 further includes a tracking assembly 72 defined between the interior of the tip-moving device 50 and the exterior of the second side of the applicator body 32 for guiding the tip-moving device 50 axially along the applicator body 32 between the first and second positions. Although any suitable tracking assembly may be used for guiding the tip-moving device 50 along the applicator body 32, in the exemplary depicted embodiment, the tracking assembly 72 is defined by first and second guides 80 and 82 slidably receivable on a guiderail 84.

The guiderail 84 extends substantially axially along the exterior of the second side of the applicator body 32 within a recess 76 of the applicator body 32, and the first and second guides 80 and 82 extend from an interior surface of the tip-moving device 50. It should be appreciated that the guiderail 84 may instead be formed on the interior surface of the tip-moving device 50 and the first and second guides 80 and 82 may extend from the exterior of the second side of the applicator body 32.

The guiderail 84 is configured such that the first and second guides 80 and 82, which are substantially L-shaped in cross section, are snap-fit onto the guiderail 84 to retain the first and second guides 80 and 82 thereon. In that regard, the first and second guides 80 and 82 are disposed on opposite sides of the tip-moving device 50 and extend toward each other such that the guiderail 84 may be disposed therebetween with the first and second guides 80 and 82 received on opposite sides of the guiderail 84. In other words, the first and second guides 80 and 82 are received on opposite sides of the guiderail 84 such that the tip-moving device 50 is slidably secured to the guiderail 84. The first and second guides 80 and 82 slide axially along the guiderail 84 to guide the tip-moving device 50 between the first and second positions.

The tracking assembly 72 may include a locking assembly for selectively locking the tip-moving device 50 (and therefore the applicator tip 26) in the first and second positions. In the exemplary embodiment, the guiderail 84 includes first and second lateral protrusions 86 and 88 extending laterally from the guiderail 84 at upper and lower locations for selectively retaining the tip-moving device 50 in the first or second position. More specifically, the first lateral protrusion 86 is defined near a lower end of the guiderail 84 on a first side of the guiderail 84, and the second lateral protrusion 88 is defined near an upper end of the guiderail 84 on a second opposite side of the guiderail 84.

The first guide 80 is configured to slide downwardly past the first lateral protrusion 86 when the tip-moving device 50 is moved downwardly into the first position to selectively secure the tip-moving device 50 in the first position. Similarly, the second guide 82 is configured to slide upwardly past the second lateral protrusion 88 when the tip-moving device 50 is moved upwardly into the second position to retain the tip-moving device 50 in the second position. The first and second guides 80 and 82 are at least somewhat deformable such that they may deform outwardly to move past the first or second lateral protrusion 86 or 88. When moved past the first or second lateral protrusion 86 or 88, the first or second guide 80 or 82 deforms back inwardly toward the longitudinal center axis of the guiderail 84 to provide a tactile sensation to the user that the tip-moving device 50 has been moved into the first or second position. It should be appreciated that any other suitable tracking assembly and selective locking assembly may instead be used.

The operation of the adjustable applicator 20 will now be described with reference to FIGS. 2-6. The applicator tip 26 may be moved between a first, substantially 0-degree position and a second, substantially 90-degree position for a specific application or use. As noted above, the applicator tip 26 is moved between the first and second positions through the actuator assembly 26. More specifically, to move the applicator tip 26 from the first, substantially 0-degree position to the second, substantially 90-degree position, the tip-moving device 50 is pushed up axially upwardly along the guide rail 84 until the applicator tip 26 bends about the first and second integral hinges 44 and 46 into the second, substantially 90-degree position. More specifically, the upward axial force of the tip-moving device 50 tips or folds the base portion 30 toward the second, second, substantially 90-degree position as it bends about the first and second integral hinges 44 and 46. When moved into the second position, the second guide 82 of the tracking assembly 72 passes over the second lateral protrusion 88 on the guide rail 84 to temporarily secure the tip-moving device 50 in the second position.

The adjustable applicator 20 is moved back into the first, substantially 0-degree position by sliding the tip-moving device 50 axially downwardly along the guide rail 84. When slid downwardly, the base portion 30 is pulled back upwardly out of the folded position by the tip-moving device 50 until the first and second integral hinges 44 and 46 are substantially straight (i.e., not bent or folded). When moved back into the first position, the first guide 80 of the tracking assembly 72 passes over the first lateral protrusion 86 on the guide rail 84 to temporarily secure the tip-moving device 50 in the first position.

The first and second integral hinges 44 and 46 may be formed so as to bias the applicator tip 26 into or out of the first and/or second positions. Moreover, any other suitable hinge assembly may instead be used to allow the applicator tip 26 to be moved into and out of at least the first and second positions.

Figure 7A:
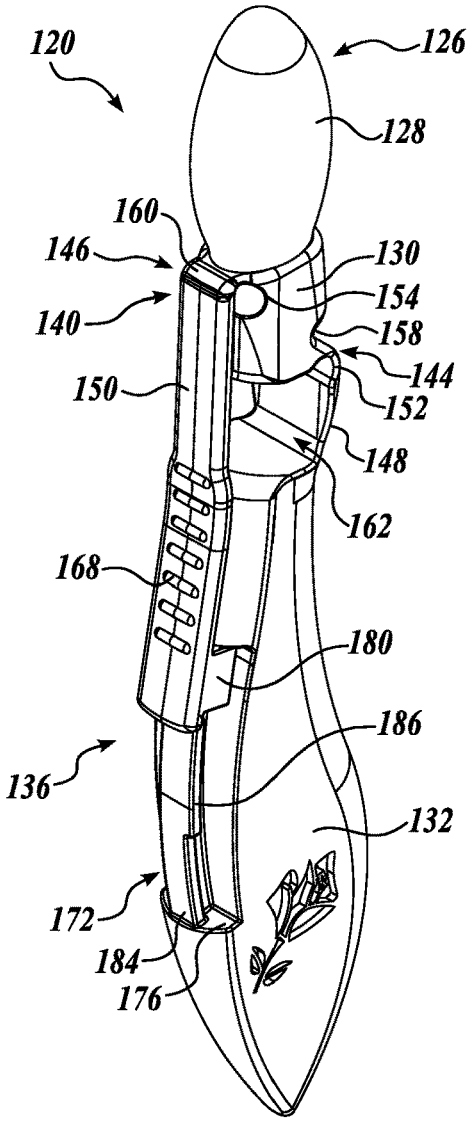
FIG. 7A is a rear isometric view of an adjustable applicator formed in accordance with a second exemplary embodiment of the present disclosure, wherein the adjustable applicator is shown in a first position.
Figure 7B:
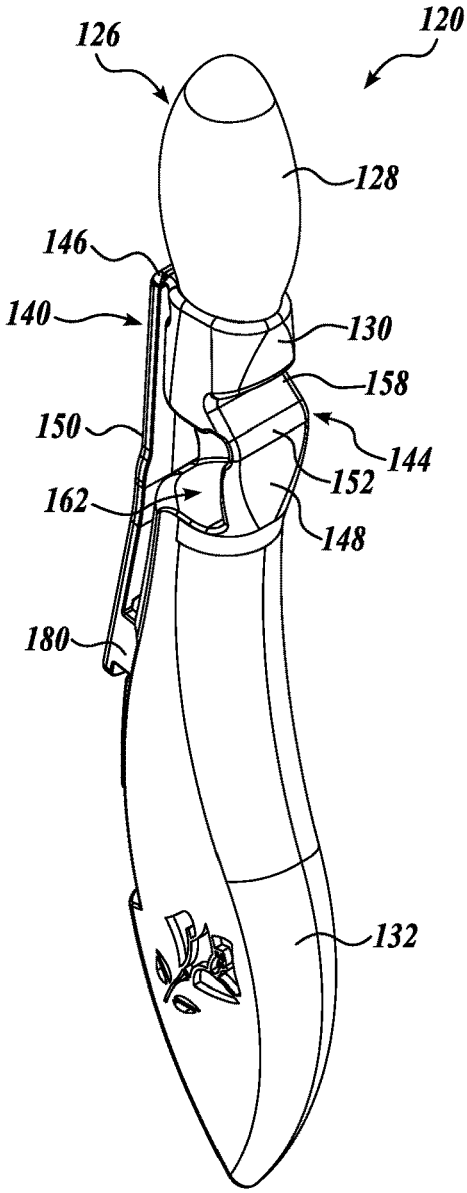
FIG. 7B is a front isometric view of the adjustable applicator of FIG. 7A.
Figure 8D:
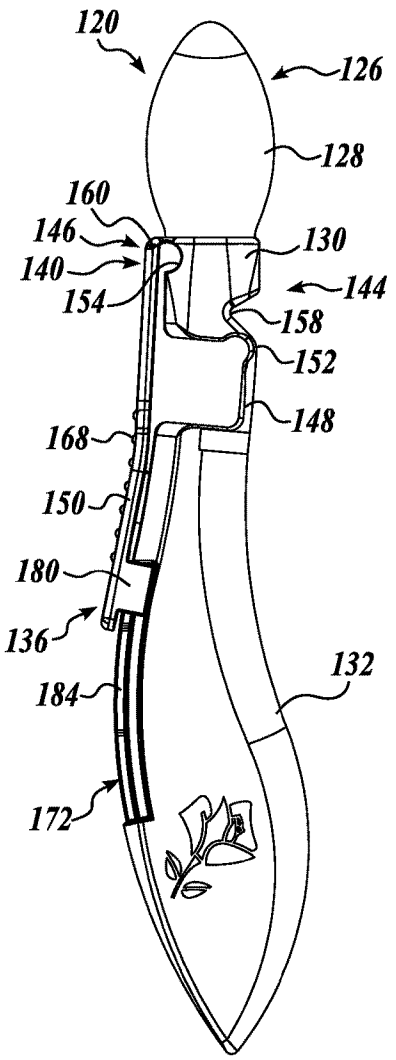
FIG. 8D is a rear elevational view of the adjustable applicator of FIG. 7A.
Figure 8C:
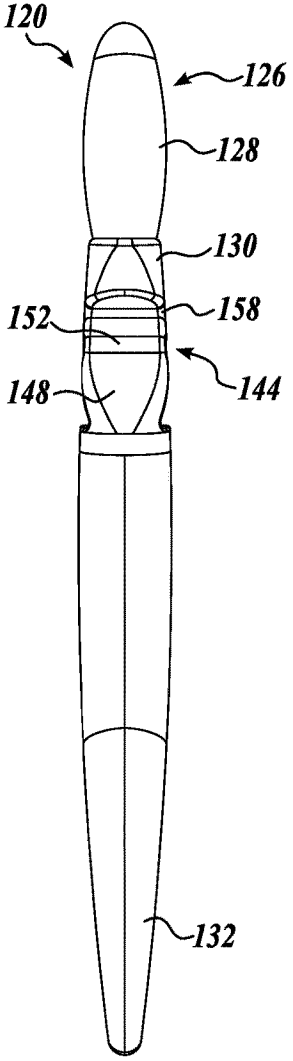
FIG. 8C is a left side perspective view of the adjustable applicator of FIG. 7A.
Figure 8B:
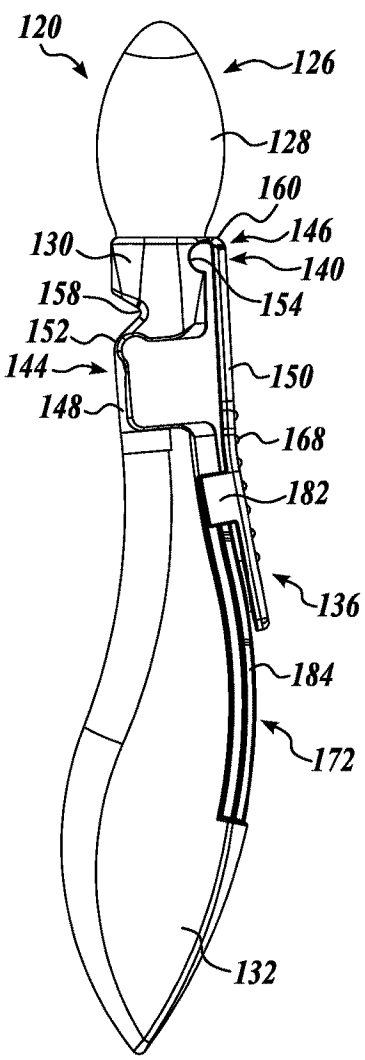
FIG. 8B is a front elevational view of the adjustable applicator of FIG. 7A.
Figure 8A:
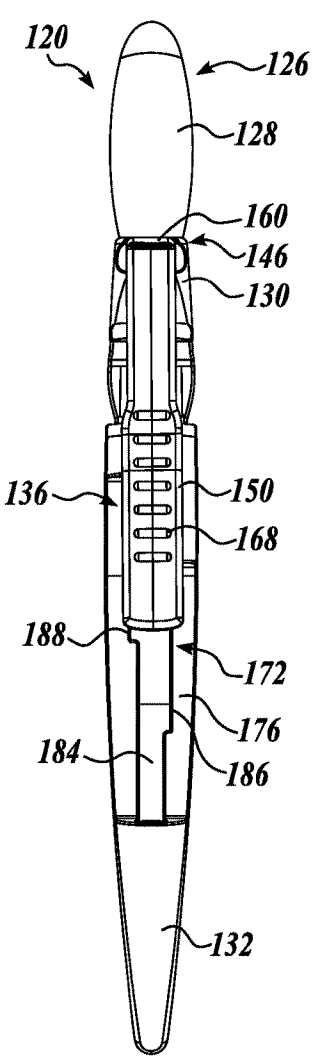
FIG. 8A is a right side perspective view of the adjustable applicator of FIG. 7A.
Figure 9A:
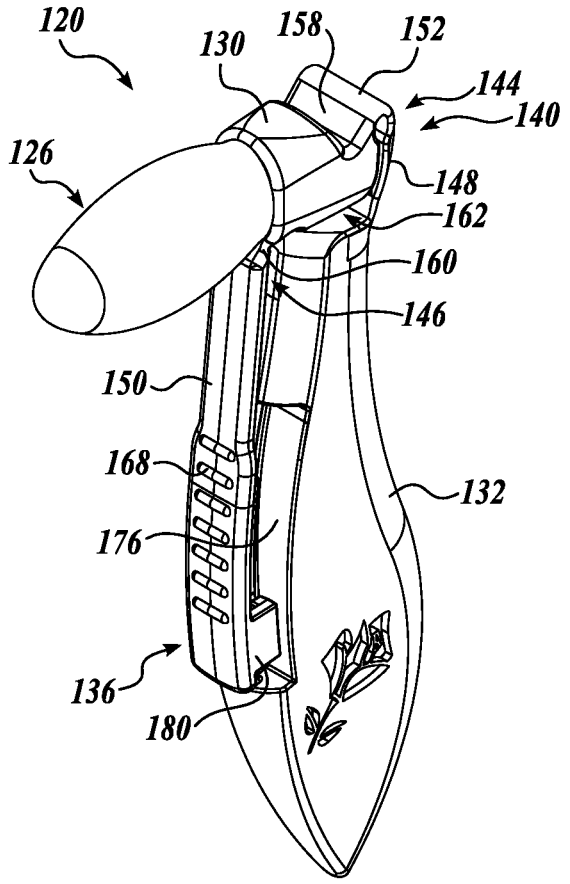
FIG. 9A is a rear isometric view of the adjustable applicator of FIG. 7A, wherein the adjustable applicator is shown in a second position.
Figure 9B:
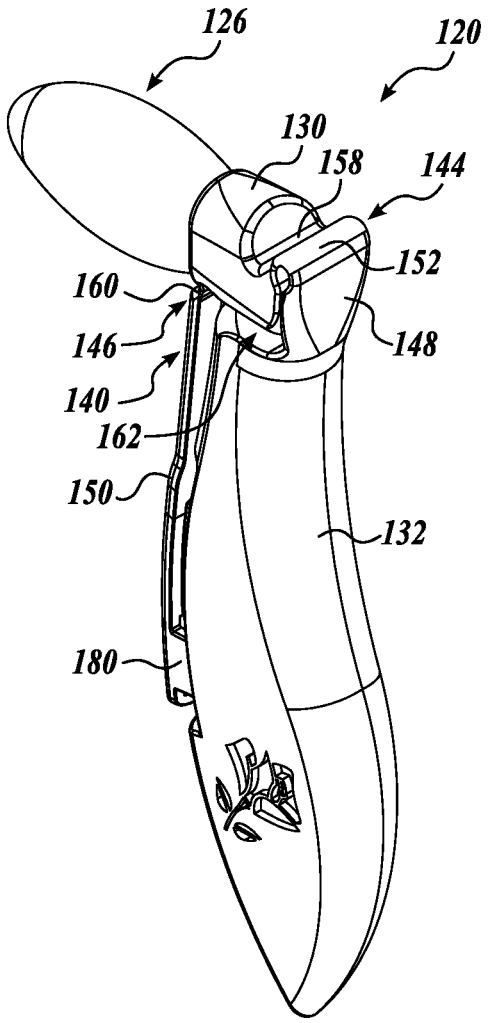
FIG. 9B is a front isometric view of the adjustable applicator of FIG. 9A.
Figure 10D:
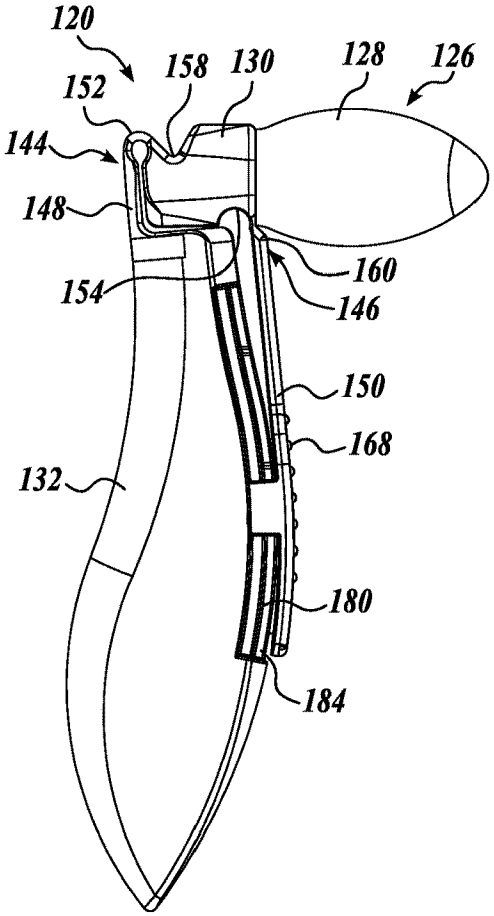
FIG. 10D is a rear elevational view of the adjustable applicator of FIG. 9A.
Figure 10C:
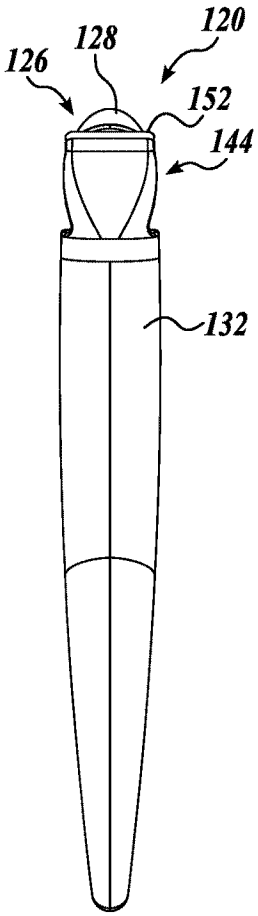
FIG. 10C is a left side perspective view of the adjustable applicator of FIG. 9A.
Figure 10B:
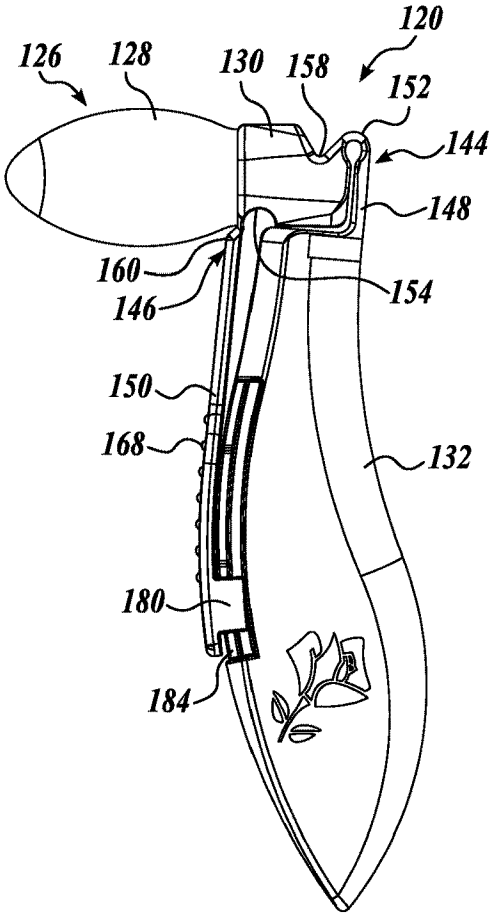
FIG. 10B is a front elevational view of the adjustable applicator of FIG. 9A.
Figure 10A:
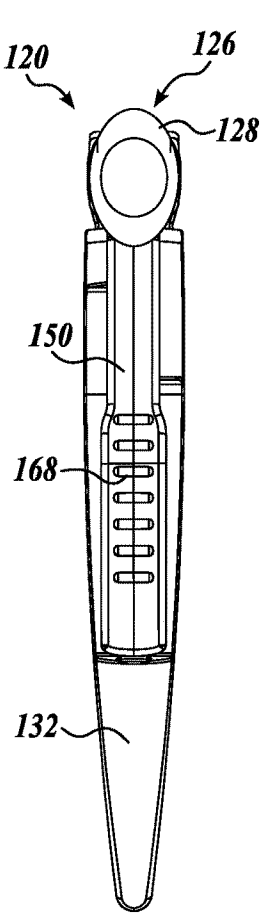
FIG. 10A is a right side perspective view of the adjustable applicator of FIG. 9A.
Figure 11A:
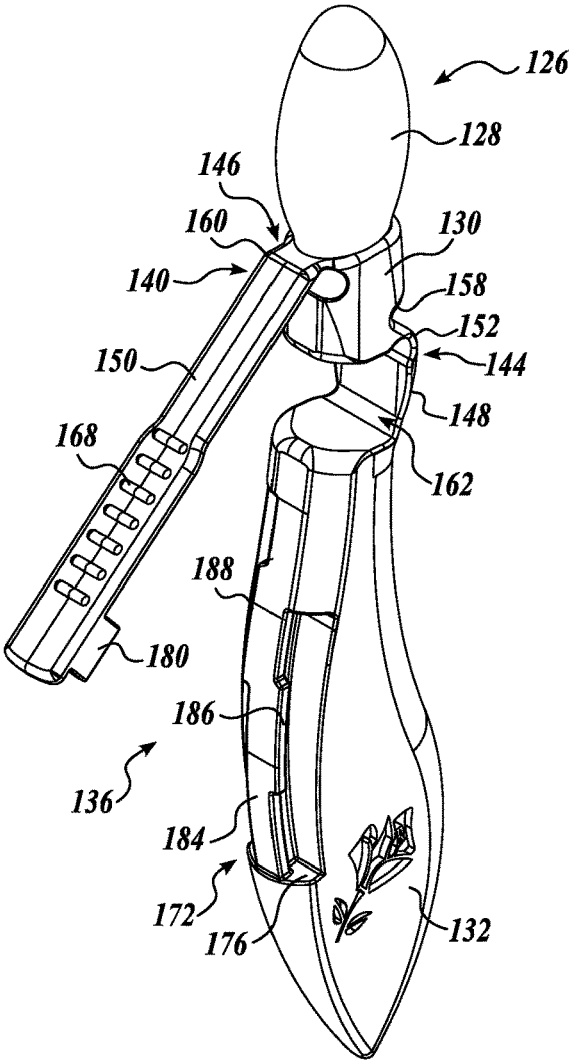
FIG. 11A is a rear isometric partially exploded view of the adjustable applicator of FIG. 7A.
Figure 11B:
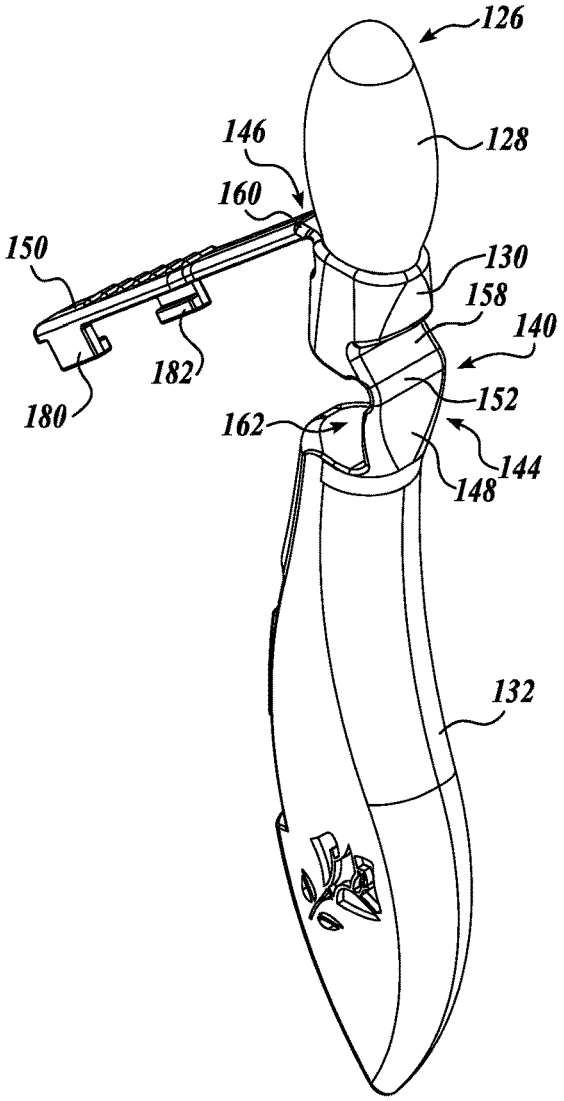
FIG. 11B is a front isometric partially exploded view of the adjustable applicator of FIG. 7A.

In that regard, a second exemplary embodiment of an adjustable applicator 120 having a hinge assembly 140 will now be described with reference to FIGS. 7-11. The adjustable applicator 120 is substantially similar to the adjustable applicator 20 described above with reference to FIGS. 1-6; therefore, certain like parts will be numbered with like numerals except in the '100 series. The adjustable applicator 120 includes an applicator tip 126 that is hingedly secured to an applicator body 132 through the hinge assembly 140, and moveable between a first, substantially 0-degree position, as shown in FIGS. 7 and 8, and a second, substantially 90-degree position, as shown in FIGS. 9 and 10, through an actuator assembly 136.

Similar to the applicator body 32, the applicator body 132 is a generally contoured, elongated body that is easily graspable by the user. However, any suitable shape and contour may instead be used. Likewise, the applicator tip 126 is substantially similar to the applicator tip 26 described above in that it includes a tip portion 128 extending from a base portion 130, wherein the base portion 130 is coupled to a first or upper end of the applicator body 132. The tip portion 128 is shown as a sponge tip applicator; however, as noted above with reference to the applicator tip 26, the tip portion 128 may instead be any suitable configuration, such as a bristle assembly, a brush, etc.

The base portion 130 of the applicator tip 126 is moveably secured to the applicator body 132 through the hinge assembly 140. In the depicted exemplary embodiment, the hinge assembly 140 includes a first integral hinge 144 that hingedly couples the base portion 130 to a first or upper end of the applicator body 132, and a second integral hinge 146 that hingedly couples the base portion 130 to a movement device 150 of the actuator assembly 136.

The first integral hinge 144 is defined by a thin connector piece 148 extending between and integrally formed with the applicator body 132 and the base portion 130. In that regard, the connector piece 148 extends between the first or upper end of the applicator body 132 on a first side of the applicator body 132 to a lower end of the base portion 130 on a first side of the base portion 130. Although any suitable configuration may be used, the connector piece 148 is substantially the same width as the applicator body 132 and the base portion 130 at their upper and lower ends, respectively. An area of reduced-width, thinner-cross-section, increased deformability, etc., defines a first hinge portion 152 within the connector piece 148 that has a first hinge axis substantially transverse to the longitudinal access of the applicator body 132. The first hinge portion 152 allows for flexible bending of the connection member about the first hinge axis for moving the applicator tip 126 between the first and second positions. A transverse notched portion 158 may be defined at the bottom of the first side of the base portion 130 at the joinder of the base portion 130 and the connector piece 148, to help facilitate the flexible bending of the connector piece 148 at the first hinge axis.

As can be seen in the figures, when the connector piece 148 bends about the first hinge axis, the applicator tip 126 is moved between at least a first position, wherein the applicator tip 126 is in a substantially 0-degree position in substantial axial alignment with the applicator body 132 (as shown in FIGS. 7A and 7B and 8A through 8D), and a second position, wherein the applicator tip 126 is in a substantially 90-degree position and substantially transverse to a longitudinal axis of the applicator body 132 (as shown in FIGS. 9A and 9B, and 10A through 10D). When moved into the second position, the base portion 130 bends inwardly toward the applicator body 132 and fits within an opening or cavity defined by the connector piece 148 spacing apart the applicator body 132 and the base portion 130.

When the applicator tip 126 is bent inwardly into the second position, the second integral hinge 146 opens to allow flexible bending between an upper end of the base portion 130 (on its second side) and the tip-moving device 150. In this manner, the applicator tip 126 may be moved between at least the first and second positions by axial movement of the tip-moving device 150. The second integral hinge 146 is defined by an area of reduced-width, reduced cross-sectional thickness, increased deformability, etc., that defines a second hinge portion 160 having a second hinge axis that is substantially transverse to the longitudinal axis of the applicator body 132. The second hinge portion 160 is connected to an upper edge portion of the base portion 130, and a transverse notched portion 154 extends substantially transversely along a base portion 130 just below the second hinge portion 160 to increase the flexibility and bending of the second hinge portion 160 about the second hinge axis. The tip-moving device 150 extends downwardly from the second hinge portion 160 at its first or upper end and is slideably secured to a tracking assembly 172 of the applicator body 132 at its second or lower end.

The tip-moving device 150 and the corresponding tracking assembly 172 for slideably securing the tip-moving device 150 to the applicator body 132 is substantially similar to that described above with respect to the adjustable applicator 20. In that regard, the tip-moving device 150 includes a suitable gripping portion, such as protrusions 168, for assisting in the sliding movement of the tip-moving device 150 upwardly and downwardly along the applicator body 132. Moreover, the tracking assembly 172 is defined by a guide rail 184 extending axially along a second side of the applicator body 132 within a recess 176, and having first and second lateral protrusions 186 and 188 defined on opposite sides of the guide rail 184 at lower and upper ends of the guide rail 184. Moreover, first and second guides 180 and 182 are disposed on the interior or back side of the tip-moving device 150 and spaced on opposite lateral edges of the tip-moving device 150 and near lower and upper ends thereof for securing the tip-moving device 150 slideably to the guide rail 184, and for selectively locking the tip-moving device 150 in first and second, or upper and lower, positions when the second and first guides 182 and 180 pass over the second and first lateral protrusions 188 and 186, respectively.

When the tip-moving device 150 is moved from its first initial position, as shown in FIGS. 7A and 7B and FIGS. 8A through 8D, to a second position, as shown in FIGS. 9A and 9B, and FIGS. 10A through 10D, the second integral hinge 146 opens and bends about the second hinge portion 160 to allow the tip-moving device 150 to slide axially and downwardly along the guide rail 184. To move the applicator tip 126 back into the first position, the tip-moving device 150 is slid axially upwardly along the guide rail 184. When the tip-moving device 150 is moved axially upwardly, the second integral hinge 146 bends about the second hinged portion 160 to close the second integral hinge 146.

It can be appreciated that an adjustable applicator formed in accordance with the present disclosure may instead include any suitable integral hinge assembly and any suitable actuator assembly for moving the adjustable tip between a first, substantially 0-degree position and a second, substantially 90-degree position. Moreover, it should be appreciated that the adjustable applicator may instead be modified to move the adjustable tip between any suitable positions. Furthermore, although a benefit of the adjustable applicators 20 and 120 described above is that they are formed from a single, molded piece, the adjustable applicators may instead by formed from two or more parts connected together by suitable means. However, in the exemplary embodiments, the adjustable applicators are molded as a single part and are made from any suitable material to allow for flexible bending at the first and second integral hinges, such as polypropylene plastic.

The detailed description set forth above in connection with the appended drawings is intended as a description of exemplary embodiments of the disclosed subject matter and is not intended to represent the only embodiments. The exemplary embodiments described in this disclosure are provided merely as examples or illustrations of an adjustable cosmetic applicator and should not be construed as preferred or advantageous over other embodiments. The illustrative examples provided herein are not intended to be exhaustive or to limit the disclosure to the precise forms disclosed. Similarly, any features and/or process steps described herein may be interchangeable with other features and/or process steps, or combinations of features and/or process steps, in order to achieve the same or substantially similar result.

In the foregoing description, numerous specific details are set forth in order to provide a thorough understanding of the exemplary embodiment of the present disclosure. It will be apparent to one skilled in the art, however, that many embodiments of the present disclosure may be practiced without some or all of the specific details. In some instances, well-known features, subassemblies, and/or process steps have not been described in detail in order not to unnecessarily obscure various aspects of the present disclosure. Further, it will be appreciated that embodiments of the present disclosure may employ any combination of features described herein.

The present disclosure includes references to directions, such as "upper," "lower," "upward," "downward," "top," "bottom," "first," "second," etc. These references and other similar references in the present disclosure are only to assist in helping describe and understand the exemplary embodiments and are not intended to limit the claimed subject matter to these directions. The term "cosmetic product" or "cosmetic" (as used with the phrase "cosmetic adjustable applicator") should be interpreted broadly to include any cosmetic formulation, beauty product, lotion, lacquer, etc., generally applied to a person's skin, eyes, nails, or other body part.

The present disclosure may also reference quantities and numbers. Unless specifically stated, such quantities and numbers are not to be considered restrictive, but exemplary of the possible quantities or numbers associated with the present disclosure. Also in this regard, the present disclosure may use the term "plurality" to reference a quantity or number. In this regard, the term "plurality" is meant to be any number that is more than one, for example, two, three, four, five, etc. The terms "about," "approximately," etc., mean plus or minus 5% of the stated value.

While illustrative embodiments have been illustrated and described, it will be appreciated that various changes can be made therein without departing from the spirit and scope of the invention.

The embodiments of the invention in which an exclusive property or privilege is claimed are defined as follows:

1. An adjustable cosmetic applicator, comprising:

an applicator tip moveable relative to an applicator body between at least a first and a second position; and an actuator assembly configured to move the applicator tip between the at least first and second positions, wherein the applicator tip, the applicator body, and the actuator assembly are integrally formed as a single molded part.

2. The applicator of claim 1, wherein the applicator tip is in substantial axial alignment with the applicator body in the first position, and wherein the applicator tip is substantially transverse to the applicator body in the second position.

3. The applicator of claim 1, wherein the applicator tip is hingedly connected to the applicator body.

4. The applicator of claim 1, wherein the applicator tip is coupled with a tip portion.

5. The applicator of claim 1, wherein the actuator assembly is configured to move the applicator tip between the at least first and second positions upon movement of a tip-moving device.

6. The applicator of claim 5, further comprising a locking assembly for securing the tip-moving device in the first position or the second position.

7. The applicator of claim 5, wherein the applicator tip is hingedly connected to the applicator body through a first integral hinge, and wherein the tip-moving device is hingedly connected to the applicator body through a second integral hinge.

8. The applicator of claim 5, wherein the tip-moving device is slidable along the applicator body through a tracking assembly.

9. The applicator of claim 8, wherein the tracking assembly is defined by a guide rail extending axially along the applicator body and first and second guides extending from the tip-moving device that are slidably receivable on the guide rail.

10. The applicator of claim 9, wherein the tracking assembly includes a locking assembly for securing the tip-moving device in the first position or the second position.

11. The applicator of claim 10, wherein the locking assembly includes first and second lateral protrusions extending from the guide rail, wherein the first guide passes over the first lateral protrusion to selectively lock the tip-moving device in the first position, and wherein the second guide passes over the second lateral protrusion to selectively lock the tip-moving device in the second position.

12. The applicator of claim 10, wherein the locking assembly includes first and second lateral protrusions extending from the guide rail, wherein the second guide passes over the second lateral protrusion to selectively lock the tip-moving device in the first position, and wherein the first guide passes over the first lateral protrusion to selectively lock the tip-moving device in the second position.

13. The applicator of claim 10, wherein the applicator tip is in the first position when the tip-moving device is in the first position, and wherein the applicator tip is in the second position when the tip-moving device is in the second position.

14. The applicator of claim 10, wherein the applicator tip is in the first position when the tip-moving device is in the second position, and wherein the applicator tip is in the second position when the tip-moving device is in the first position.

15. An adjustable cosmetic applicator, comprising:

an applicator tip moveable relative to an applicator body between at least a first and a second position;

a first integral hinge defined between the applicator tip and the applicator body;

an actuator assembly configured to move the applicator tip between at least the first and second positions; and a second integral hinge defined between the applicator tip and the actuator assembly.

16. The applicator of claim 15, wherein the applicator tip is in substantial axial alignment with the applicator body in the first position, and wherein the applicator tip is substantially transverse to the applicator body in the second position.

17. The applicator of claim 15, wherein the applicator tip, the applicator body, and the actuator assembly are integrally formed as a single molded part.

18. The applicator of claim 15, wherein the actuator assembly is configured to move the applicator tip between the at least first and second positions upon movement of a tip-moving device.

19. The applicator of claim 18, further comprising a locking assembly for securing the tip-moving device in the first position or the second position.

20. The applicator of claim 18, wherein the tip-moving device is slidable along the applicator body through a tracking assembly.

* * * * *